United States Patent [19]

Bauer

[11] Patent Number: 4,556,781

[45] Date of Patent: Dec. 3, 1985

[54] SELF-REGULATING ELECTRIC GLOW PLUG

[75] Inventor: Paul Bauer, Steinheim-Murr, Fed. Rep. of Germany

[73] Assignee: Firma Beru-Werk, Albert Ruprecht, GmbH & Co. KG, Ludwigsburg, Fed. Rep. of Germany

[21] Appl. No.: 682,490

[22] Filed: Dec. 18, 1984

Related U.S. Application Data

[63] Continuation of Ser. No. 969,634, Dec. 14, 1978, abandoned.

[30] Foreign Application Priority Data

Jan. 21, 1978 [DE] Fed. Rep. of Germany ..... 2802625

[51] Int. Cl.[4] ..... F23Q 7/00; F02P 19/02; H05B 3/00

[52] U.S. Cl. ..... 219/270; 123/145 A; 219/205; 219/505; 361/264

[58] Field of Search ..... 219/205–207, 219/504, 505, 270; 361/264–266; 123/145 R, 145 A

[56] References Cited

U.S. PATENT DOCUMENTS

| | | | |
|---|---|---|---|
| 1,948,974 | 2/1934 | Talmey | 123/145 A |
| 2,492,755 | 12/1949 | McCollum | 361/266 X |
| 2,672,546 | 3/1954 | Klingner et al. | 123/145 A X |
| 3,023,295 | 2/1962 | Johnson | 219/237 X |
| 3,164,748 | 1/1965 | Testerini | 123/145 A |
| 4,107,510 | 8/1978 | Tombs et al. | 361/264 X |

FOREIGN PATENT DOCUMENTS

| | | | |
|---|---|---|---|
| 1426173 | 1/1969 | Fed. Rep. of Germany . | |
| 2743059 | 1/1978 | Fed. Rep. of Germany . | |
| 254482 | 7/1926 | United Kingdom | 123/145 A |
| 1127454 | 9/1968 | United Kingdom | 219/270 |

*Primary Examiner*—Anthony Bartis

*Attorney, Agent, or Firm*—Fleit, Jacobson, Cohn & Price

[57] ABSTRACT

A self-regulating electric glow plug for an air-compressing internal combustion engine includes an elongated tube having a first end arranged within a plug housing and a second closed end defining a tubular component adapted to extend into a combustion chamber of the engine to produce heat when heated to a glowing condition. A coiled electric resistance heating element is disposed entirely within the tubular component and is embedded in a mass of thermally conductive electrical filling the tube. The resistance element includes two oppositely wound resistance wire coils connected in an end-to-end serially connected array with the first coil being located closest to the glow plug housing and the second coil being located closest to the closed tube end. The first coil has a higher positive temperature coefficient of resistance than the second coil. The second coil defines a heating element for the combustion chamber of the engine and has the capability of heating the entire tubular component in which the coils are located to incandescence within three to five seconds after being energized. The first coil is thus affected not only by internal heat produced by the current flow through at but also by the heat from the tubular component heated to incandescence by the second coil so that the resistance of the first coil increases rapidly to reduce the initially high current flow through the serially connected coils and prevent overheating of the glow plug.

4 Claims, 2 Drawing Figures

SELF-REGULATING ELECTRIC GLOW PLUG

This application is a continuation of application Ser. No. 969,634, filed Dec. 14, 1978 now abandoned.

The invention relates to a heater plug and more particularly to a heater plug useful in assisting the starting procedure for internal combustion engines.

When the engine is so cold as to be below the self-starting temperature, air-compressing internal combustion engines must be started with the help of heater plugs. In so doing, the incandescent part of the heater plug is seated in the combustion chamber of the engine and ignites the surrounding fuel/air mixture.

The heater plugs require a certain amount of time in order to heat up to the operating temperature. Only then can the internal combustion engine be started. This time period, which is also referred to as pre-incandescent time, is relatively long for normal heater plugs and therefore represents a disadvantage relative to the gasoline engine, which is immediately ready for starting.

Efforts are therefore made to reduce pre-incandescent time to as brief a period as possible.

In order to achieve this, devices have become known, by means of which a normal heater plug is initially supplied with an excessive current. When the incandescence temperature is reached, this current is limited by connecting a resistance in series. Devices have also been proposed by means of which the excessive current, after the incandescence temperature has been reached, is supplied only intermittently (German Patent Application No. P 27 43 059.7).

The disadvantage of these solutions is the fact that, in addition to the heater plug, additional circuit components are required in order to shorten the pre-incandescent time.

A different solution is revealed by the British Pat. No. 1,127,454. In this patent, a heater plug at the end of an open tubular component, which extends into the combustion chamber of the engine, has a heating element which is connected through a resistance element to a connecting device. Relative to the heating element, the resistance element has a high positive temperature coefficient of resistance—the resistance increases more rapidly as the temperature increases—and therefore initially, when the heater plug is switched on, allows a high current to flow to the heating element. The heating element heats up very rapidly. The incandescent current however also heats up the resistance element, whose resistance increases and reduces the initially high incandescent current.

In the case of this heater plug, essentially only the heating element is incandescent and in many cases this incandescent surface area is too small to ignite the fuel/air mixture. The increase in resistance to the resistance element is intended to prevent overheating of the heating element. In so doing however, the resistance element is not exposed to the temperature of the heating element, but to the level of the current flowing through it. The resistance value therefore does not regulate itself directly as a function of the incandescent temperature. Moreover, the heating element is exposed directly to the combustion gases and therefore to the danger, that it will be attacked and destroyed by these gases.

It is therefore an object of the invention to devise a heater plug, whose design is simple and which heats up rapidly to its incandescence temperature. At the same time, the surface area of the incandescence shall be of such a size that it is certain to ignite the fuel/air mixture. Moreover, it is an object of the invention that the heater plug is resistant to attack by the gases of combustion, and that its incandescence temperature effects the level of the heating current directly.

This is accomplished in accordance with this invention by means of a heater plug for an air-compressing internal combustion engine, which includes a plug housing and a tubular component disposed therein. The tubular component is closed off at one end and a resistance element, packed in an insulating material, is disposed in the component. A connecting device of the heater plug is connected electrically to the resistance element and the resistance element includes at least two, oppositely wound, resistance coils connected to one another and having different positive temperature coefficients of resistance, the coil closer to the closed end (front coil) having a lower positive temperature coefficient of resistance than the resistance coil further from the closed end (rear coil) of the tubular component. Resistance coils are arranged in the part of the tubular component which forms the heater plug itself.

When the heater plug is switched on, a high current flows in the front resistance coil, which causes the tip of the heater plug to glow, The incandescence spreads out and, after three to five seconds, the whole of the part of the tubular component, which extends into the combustion chamber of the engine, is glowing. The incandescence also covers the rear resistance coil, whose resistance increases with increasing temperature and reduces the level of the incandescence current. By these means, the resistance of this coil is effected not only by its internal heat, produced by the current flowing through it, but also by the incandescence temperature. It is therefore not possible for the heater plug to overheat.

Other objects, features and advantages of the present invention will become apparent by reference to the following more detailed description of a preferred, but nonetheless illustrative embodiment, with reference to the accompanying drawing, wherein.

Figure 1:
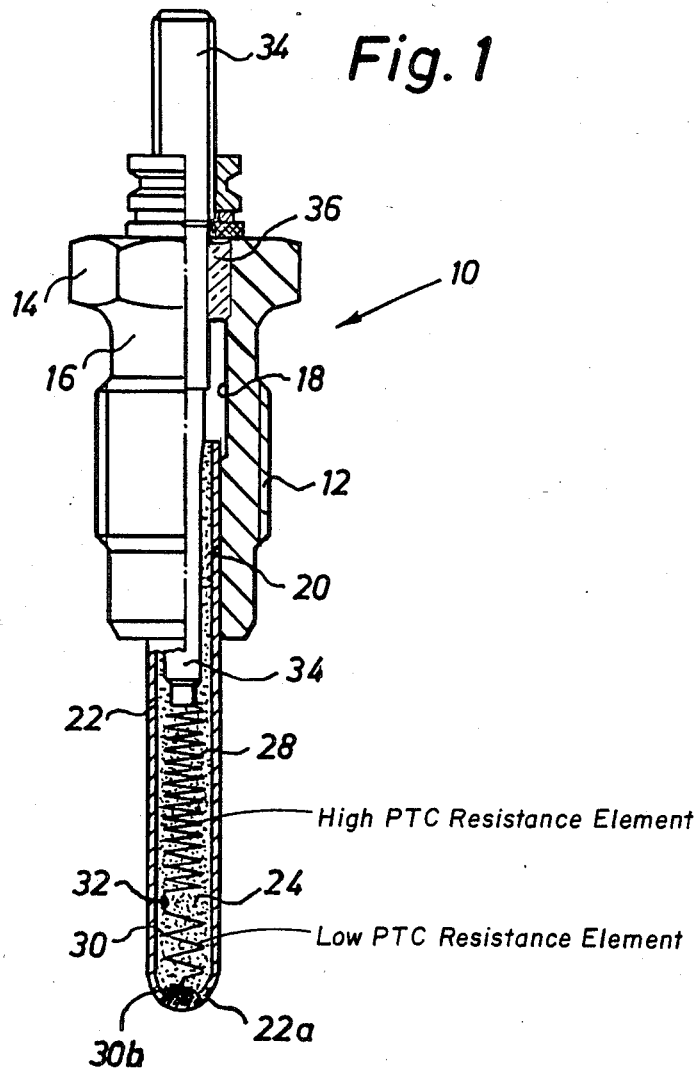
FIG. 1 shows a partial section of a heater plug.

A heater plug 10 consists essentially of a plug housing 16, equipped with a thread 12 and a hexagon 14, in whose central longitudinal borehole 18 a tubular component 22 is fastened at the narrower part 20 by brazing, or in some other manner. The component 22 is closed off at its free end **22*a* and extends as a heater plug portion into the combustion chamber of the engine of an air-compressing internal combustion engine, which is not shown. The component 22** consists of a temperature-resistant material, which in addition is resistant to attack by combustion gases.

Figure 2:
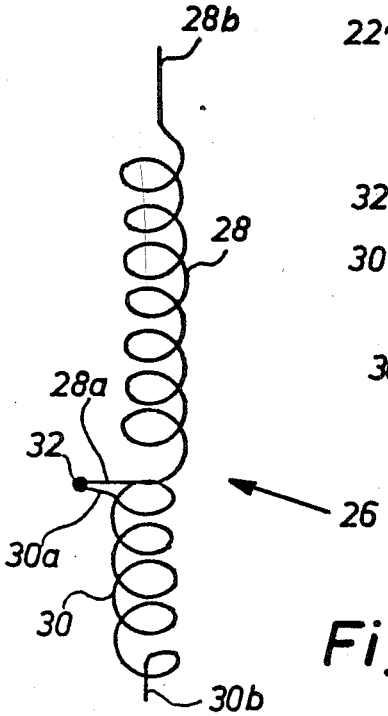
FIG. 2 shows a resistance element, consisting of two resistance coils, on an enlarged scale.

In that part of component 22, which acts as heater plug, there is a resistance element 26, which is packed in a ceramic powder 24 and consists of resistance coils 28 and 30 (in FIG. 1, the resistance unit is only shown schematically). The coils 28 and 30 are connected at their ends **28*a* and 30*a* by welding 32 or by a similar means of attachment. Coil 28 has a more highly positive temperature coefficient of resistance than coil 30. In order to facilitate welding end 28*a* to end 30*a*, it has proven to be advantageous if the direction of rotation of the coils is opposite (FIG. 2). As a result, the two ends 28*a* and 30*a* run parallel to one another and can be welded easily. After welding, the connected ends are turned into the coils, so that, when the resistance unit 26 is installed, the ends cannot touch the wall of component 22** and cause a short circuit.

The end 30*b* of the resistance coil 30 is welded to the tip 22*a* of component 22; the end 28*b* of coil 28 is welded to a connecting pin 34. The connecting pin 34 is attached in the housing 16 of the plug by a glass seal 36 or by similar means and provides a connection for the incandescence current from a battery, which is not shown, to the heater plug 10.

It is readily seen that the heating-up or pre-incandescence time of the heater plug and the incandescene temperature of this plug can be adapted to any requirements by the appropriate change in the coils and in their materials of construction.

The foregoing description clearly illustrates the present invention, which is to be limited only by the following claims:

What is claimed is:

1. Glow plug for a combustion-chamber of an air-compressing internal combustion engine, said glow plug comprising:

a glow plug housing;

a tube fixed at one end to the glow plug housing, the tube being closed at its end located opposite to the plug housing, the closed end of the tube extending out of the plug housing and defining a tubular component, a thermally conductive electrical insulating material located in said tubular component, a resistance element in the form of a coiled resistance wire located within said tubular component, said resistance element being embedded in said insulating material with said insulating material completely filling a space between said coiled resistance wire and said tubular component, a connecting device located on said glow plug housing and being electrically connected to said resistance element to provide a glow current thereto, the resistance element having a positive temperature-resistance-coefficient for regulation of the glow current, the resistance element including two resistance wire coils located within said tubular component and connected in an end-to-end serially connected array with one resistance wire coil being located closest to said glow plug housing and the other resistance coil wire being located closest to the closed end of said tube, the resistance wire coil located closest to said glow plug housing having a higher positive temperature-resistance-coefficient than the positive temperature-resistance-coefficient of the resistance wire coil located closest to the closed end of the tube, and the resistance coil located closest to the closed end of the tube defining a heating element for the combustion chamber of the air-compressing internal combustion engine and including the capability of heating the entire portion of the tube defining the tubular component in which both resistance wire coils embedded in the insulting material are located to incandescence within three to five seconds after being energized whereby the resistance of the coil closest to the glow plug housing is affected not only by heat produced by current flowing through it but also by the heat of the tubular component heated to incandescence by the other coil so that the resistance of the coil closest to the plug housing increases to reduce the initially high current through the serially connected coils.

2. Glow plug according to claim 1, characterized in that the two connected resistance coils are wound in opposite directions.

3. A glow plug for an air-compressing internal combustion engine, said glow plug comprising:

a plug housing, a tubular component having a first end thereof located within said plug housing, the other end of said tubular component being closed off, the other end of said tubular component adapted to extend out of said plug body into a combustion chamber of said internal combustion engine to produce heat when heated to a glowing condition, a thermally conductive electrical insulating material located in said tubular component, a positive temperature coefficient resistance element packed in said insulating material, said resistance element being disposed entirely within said tubular component extending out of said plug body to cause said tubular component to glow along a predetermined length thereof containing said resistance element when an electrical current is passed through said resistance element, said resistance element comprising a first resistance coil and a second resistance coil disposed in end-to-end relationship entirely within the outwardly extending portion of said tubular component and connected in electrical series with each other, said first resistance coil having a positive temperature coefficient of resistance which is lower than a positive temperature coefficient of resistance of said second resistance coil and said first resistance coil being located more proximate to said closed off end of said tubular component than said second resistance coil, said second coil having a substantial portion of its length disposed within said predetermined length of said tubular component caused to glow by said resistance element, and a connecting device located on said glow plug housing and being electrically connected to said resistance element to provide an electrical current thereto so as to cause the tubular component to glow from the heat generated by said electrical current flowing through the first resistance coil, the first resistance coil being so designed so that the heat generated thereby heats the entire outwardly extending portion of said tubular component surrounding said first resistance coil and said second resistance coil to incandescence within three to five seconds, said tubular component heated by said first resistance coil heating the second resistance coil thereby increasing the resistance of said second resistance coil to limit flow of said electrical current to said first resistance coil to prevent overheating of the first resistance coil after between three to five seconds of incandescence of the portion of said tubular component surrounding said first resistance coil and said second resistance coil.

4. The heater plug according to claim 3, wherein said first resistance coil and said second resistance coil are wound in opposite directions.

* * * * *